US005865354A

United States Patent [19]

Bansal

[11] Patent Number: 5,865,354

[45] Date of Patent: Feb. 2, 1999

[54] EASY OPEN DISPENSING CAP

[75] Inventor: Vinod Kumar Bansal, Edison, N.J.

[73] Assignee: Lipton, Division of Conopco, Inc., Englewood Cliffs, N.J.

[21] Appl. No.: 949,966

[22] Filed: Oct. 14, 1997

Related U.S. Application Data

[60] Provisional application No. 60/028,574, Oct. 16, 1996.

[51] Int. Cl.[6] ..... B67B 5/00; B65D 47/00; B65D 55/02; B65D 41/00

[52] U.S. Cl. ..... 222/546; 222/153.14; 222/544; 222/556; 215/224; 215/305

[58] Field of Search ..... 222/498, 499, 222/544, 546, 556, 562, 153.14; 215/224, 305, 215

[56] References Cited

U.S. PATENT DOCUMENTS

| | | | |
|---|---|---|---|
| D. 320,746 | 10/1991 | Bolen et al. | D9/446 |
| D. 335,538 | 5/1993 | Deutsch et al. | D24/169 |
| 3,744,675 | 7/1973 | Song | 222/153.14 |
| 4,022,352 | 5/1977 | Pehr | 222/153.14 |
| 4,423,822 | 1/1984 | Powalowski | 215/305 |
| 4,424,910 | 1/1984 | Heinol | 222/153.14 |
| 4,533,058 | 8/1985 | Uhlig | 222/153.14 |
| 4,993,606 | 2/1991 | Bolen et al. | 222/546 |
| 5,083,671 | 1/1992 | Hayes | 215/224 |
| 5,251,793 | 10/1993 | Bolen et al. | 222/546 |
| 5,395,015 | 3/1995 | Bolen et al. | 222/546 |

*Primary Examiner*—Andres Kashnikow
*Assistant Examiner*—Keats Quinalty
*Attorney, Agent, or Firm*—James J. Farrell

[57] ABSTRACT

An easy opening dispenser closure is disclosed having a top and an annular depending base skirt with a lid mounted on the top. The lid has a downwardly depending annular edge which in turn has an extension with an end shaped to fit the end of a thumb. The skirt has a thumb recess in which the extension fits. The extension locks the lid securely and detachably to the base skirt. The lid has a chamfered edge on the top to assist in centering the entire closure on the container during capping.

3 Claims, 1 Drawing Sheet

EASY OPEN DISPENSING CAP

This application claims the benefit of provisional application 60/028,574 filed on Oct. 16, 1996.

FIELD OF THE INVENTION

This invention generally relates to dispensing caps for containers. In particular the invention employs an extension tab on the cap lid which has a generally matching shape to a thumb recess in the base skirt. In addition the lid has an upper chamfered edge which contributes to a self centering effect when the cap is handled by capping machinery.

BRIEF DESCRIPTION OF THE INVENTION

Containers and in particular bottles which have dispensing caps must be relatively easy to open, but must also be sufficiently secure to prevent inadvertent opening and spillage of the contents.

In order to accomplish this the closure is composed of a cap having a planar top which in turn has a dispensing orifice in it. The planar top has an annular depending base skirt which adapts to be secured to the container. The top also has mounted on it a dispenser lid which can be closed to block the orifice or opened to unblock the orifice to allow dispensing of the contained product. This dispensing lid must then be engineered in such a way as to make the container secure when it is closed and the orifice is blocked yet easy to open to permit the contained product to be used.

The instant invention accordingly provides an easy opening yet secure closure for a container.

The closure has a planar cap which in turn has an annular base skirt depending therefrom, the skirt is adapted to be removably attached to the neck of the container, the top has a dispensing orifice therein, communicating with the neck of the container and a dispensing lid mounted on the top as to be movable from a position closing the orifice to a position opening the orifice, the base skirt has a thumb shaped recess therein, and the dispensing lid has an annular edge depending toward the top and an extension of the edge which fits into the thumb shaped recess and locks detachably the lid to the base skirt. The cap also has a chamfered upper edge to help center the cap in a chuck used in capping the container.

The extension of the edge of the lid locks the lid securely to the base of the cap, and the shape of the extension reflects the natural profile of the thumb. The thumb recess or relief has the extension fitted into it so as to provide an overhang to provide minimal effort opening the lid.

Further, after a neck wrap is applied over the extension it blocks opening of the dispensing lid.

Figure 1:
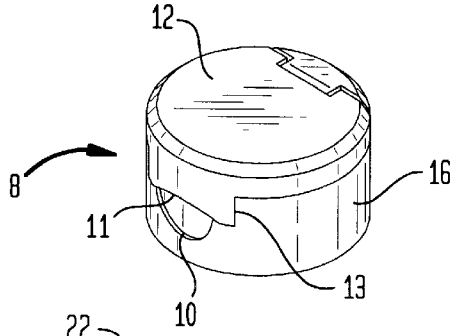
FIG. 1 is a perspective view of the closure 1 showing the dispensing lid extension and the thumb recess.
Figure 2:
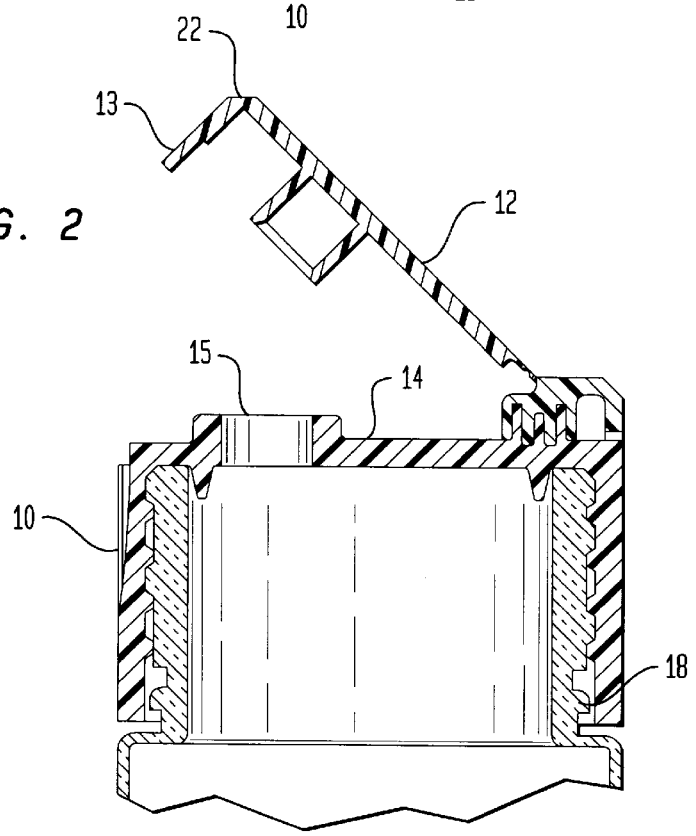
FIG. 2 is a cutaway side elevation view showing the closure on a container with the dispensing lid open.
Figure 3:
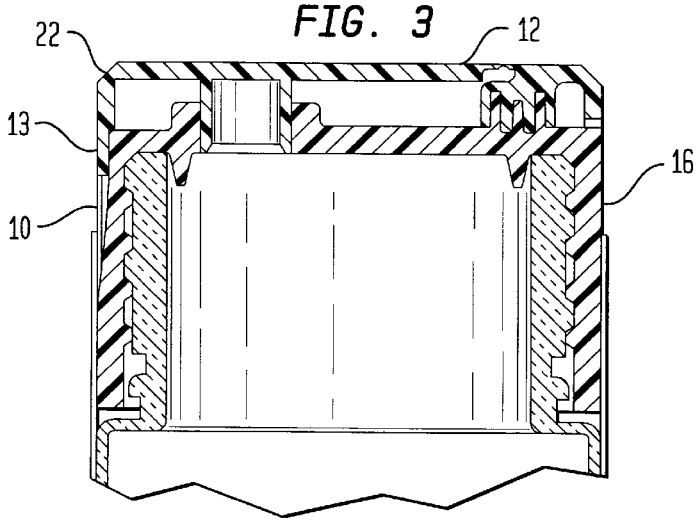
FIG. 3 is a sectional side elevation view of the closure with the dispensing lid closed.

In the drawing as shown in FIGS. 1 through 3, the dispensing lid 12 is mounted to the top 14 of the cap 8. The top 14 has a dispensing orifice 15 and an annular depending base skirt 16 adapted to be connected to the neck portion 18 of a container. The dispensing lid 12 opens and closes the dispensing orifice 15 based on its position.

Generally in operation the thumb is inserted into the thumb relief slot 10. The natural curvature of the thumb fits into the curvature 11 of the extension tab 13 on the cap 8 thus enabling the lid 12 of the cap to be opened easily with one hand.

The extended tab 13 fits snugly into the thumb relief slot so that a single curved plane on the outside of the closure is presented to facilitate application of the overwrap over the skirt 16.

The chamfered edge 22 assists centering of the cap in a chuck during capping operations. The processes for capping operations are well known in the art.

Although the invention has been described with respect to preferred embodiments thereof, variations and modifications will be readily apparent to those skilled in the art without departing from the spirit and scope of the invention as set forth in the claims.

What is claimed is:

1. An easy opening dispensing closure for a container having a generally annular neck, said closure having a top which in turn has an annular base skirt depending therefrom, the skirt having a generally thumb shaped recess therein and the skirt being adapted to match with and to be removably attached to the neck of the container, the top having a dispensing orifice therein and communicating with the neck of the container and a dispensing lid mounted on the top so as to be movable from a position closing the orifice to a position opening the orifice, the lid having an annular edge at the junction where the top of the lid meets the annular edge of the lid depending toward the top and an extension on said edge which fits into the thumb shaped recess and detachably locks the lid to the base skirt, the cap further having a chamfered upper edge to help center the cap in a chuck used in capping the container.

2. A dispensing closure as defined in claim 1 wherein said container is a bottle.

3. A dispensing closure as defined in claim 1 wherein the outside of the extension tab when closed lies in the same plane as the outside of the base skirt.

* * * * *